US005142724A

United States Patent [19]

Park

[11] Patent Number: 5,142,724

[45] Date of Patent: Sep. 1, 1992

[54] ROTARY TOOTHBRUSH

[76] Inventor: Sa R. Park, 703-405 Chugong Apt., Keapo-Dong, Kangnam-Ku, Seoul, Rep. of Korea, 135-240

[21] Appl. No.: 576,479

[22] PCT Filed: Feb. 17, 1990

[86] PCT No.: PCT/KR90/00003

§ 371 Date: Oct. 4, 1990

§ 102(e) Date: Oct. 4, 1990

[87] PCT Pub. No.: WO90/09121

PCT Pub. Date: Aug. 23, 1990

[30] Foreign Application Priority Data

Feb. 18, 1989 [KR] Rep. of Korea ..... 89-1671
May 16, 1989 [KR] Rep. of Korea ..... 89-6352

[51] Int. Cl.[5] ..... A46B 7/08
[52] U.S. Cl. ..... 15/28; 15/27
[58] Field of Search ..... 15/27, 28, 201

[56] References Cited

U.S. PATENT DOCUMENTS 1,890,943 12/1932 Hoffman ..... 15/28
1,932,878 10/1933 Akizawa ..... 15/27

FOREIGN PATENT DOCUMENTS 167764 8/1950 Austria ..... 15/27
1315706 12/1962 France ..... 15/28
1377883 9/1964 France ..... 15/27
378129 9/1932 United Kingdom ..... 15/28
459427 2/1937 United Kingdom .
488523 7/1938 United Kingdom ..... 15/28

*Primary Examiner*—Edward L. Roberts
*Attorney, Agent, or Firm*—Birch, Stewart, Kolasch & Birch

[57] ABSTRACT

A rotary toothbrush comprises a round brushhead having at least one projection, bristles on the roundbrush head, a grip, a shaft extended from the grip and eccentrically, rotatably mounted to the round brushhead, whereby the toothbrush can perfectively clean the teeth.

6 Claims, 3 Drawing Sheets

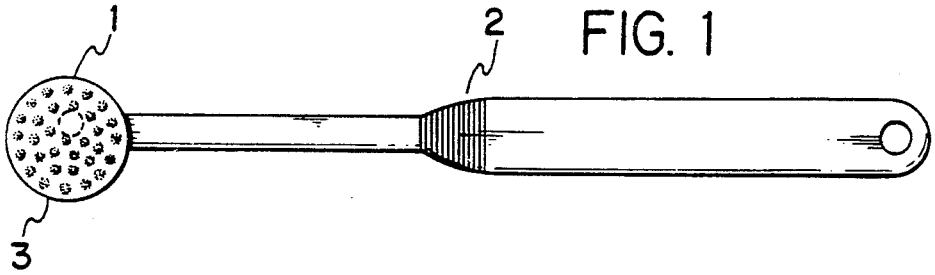
FIG. 1
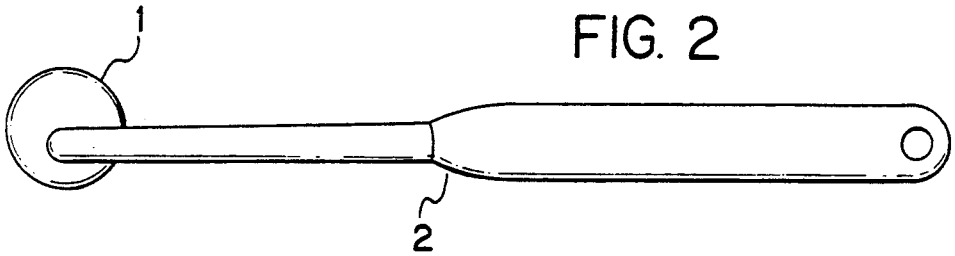
FIG. 2
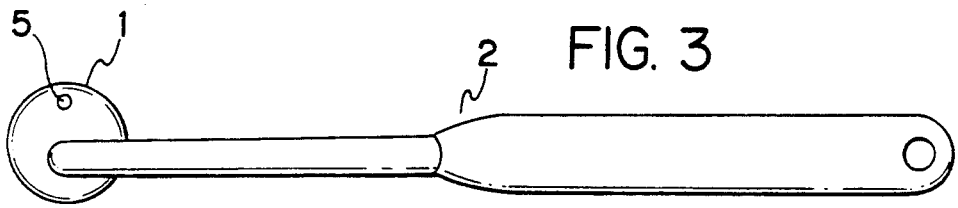
FIG. 3
FIG. 4(A)
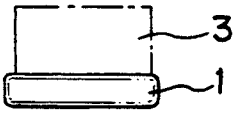
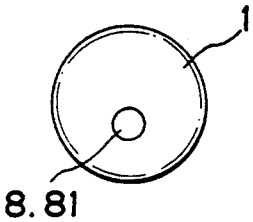
FIG. 4(B)
FIG. 4(C)
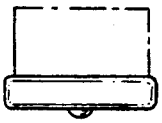
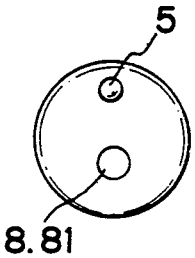
FIG. 4(D)
FIG. 4(E)
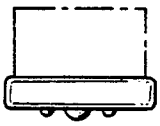
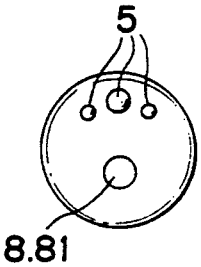
FIG. 4(F)

ROTARY TOOTHBRUSH

BACKGROUND OF THE INVENTION

1. Field of the Invention

The present invention relates to an improvement in a rotative toothbrush which brush the teeth vertically up and down as well as horizontally right and left. The effective way of brushing the teeth is to brush the teeth vertically up and down as well as horizontally right and left. The present invention is concerned with the improvement of a rotative toothbrush which automatically moves up and down when the user brushes the teeth horizontally right and left in a conventional way.

2. Description of the Prior Arts

A toothbrush most generally used is illustrated in FIG. 8. Since a human mouth is opened horizontally, it is most convenient to brush the teeth horizontally right and left.

For a long time, human beings have brushed their teeth horizontally right and left with the conventional toothbrush shown in FIG. 9. However, since such brushing of the teeth is carried out horizontally right and left, food particles and plaques existing between the teeth are not removed well.

Moreover, the teeth themselves (are worn) out horizontally by the conventional brushing of the teeth and therefore, one or more grooves near the toothridges are formed by a conventional, long brushing of the teeth.

Therefore, dentists advise that the user brushes the teeth vertically up and down. However, such vertical brushing of the teeth is not familiar to the common users and accordingly, the vertical brushing of teeth using the conventional toothbrush is very inconvenient. In order to solve these problems, U.S. Pat. No. 4,783,869 describes a toothbrush shown in FIG. 9. However, the toothbrush shown in the U.S. Pat. No. 4,783,869 does not rotate completely and the slight rotative movement forms an angle between the teeth and the toothbrush as described in the same U.S. Patent. Thus, effect of such brushing is insufficient and inadequate because as shown in FIG. 11, only a small portion of the brushhair of the brushhead contacts the teeth when the user uses the toothbrush.

The present inventor invented a rotative toothbrush as shown in FIG. 10 which the center of a round brushhead is connected with the grip by the shaft, and was filed in a Korean utility model application as No. 87-19458 (Unexamined Utility Model Publication No. 89-10102). However, as the rotative shaft is located at the center of the brushhead and as the friction (power) between the brushhairs of the brushhead and the teeth are the same in all directions, the brushhead does not rotate well. Accordingly, the effect of vertical brushing of the teeth is not, in fact, obtained. The present inventor invented the present invention as a result of an intensive study.

OBJECT OF THE INVENTION

One object of the present invention is to provide a novel toothbrush which can be moved vertically up and down as well as horizontally right and left when the user moves the toothbrush right and left in a conventional way.

The toothbrush is composed of a round brushhead having an eccentric center, a grip and a shaft in which the end of the grip is rotatively connected with said brushhead by the shaft.

Another object of the present invention is to provide a novel toothbrush which can be moved vertically up and down as well as horizontally right and left when the user moves the toothbrush right and left in a conventional way, the toothbrush composed of a round brushhead having an eccentric center in which one or more projections are formed on the back side of the brushhead along the eccentric circle thereon.

BRIEF DESCRIPTION OF THE DRAWINGS

FIG. 1 is an external view of an embodiment of the toothbrush of the present invention;

FIG. 2 is a rear view showing the toothbrush of FIG. 1 of the present invention;

FIG. 3 is an external view of another embodiment of the present invention;

FIGS. 4A and 4B illustrate the brushhead of the present invention having no projection; FIGS. 4C and 4D illustrate the brushhead of the present invention having one projection; FIGS. 4E and 4F illustrate the brushhead of the present invention having three projections;

DETAILED DESCRIPTION OF THE INVENTION

FIG. 1 shows the external form of the rotative toothbrush of the present invention. An eccentric aperture p of a round brushhead 1 is connected with the end of a grip 2 by a shaft 4. The eccentric aperture p is eccentrically and rotatively located at the center of the round brushhead 1. The rotative toothbrush is well rotative and all the brushhairs 3 of the brushhead are contacted with the teeth. As long as the ratio of the eccentricity that is, the ratio of the short radius (a): the long radius (b) of the round brushhead is large, the round brushhead will be well rotative when the user uses the rotative toothbrush of the present invention. However, it is inconvenient for the user to use the toothbrush of which the ratio of the eccentricity is large. And as long as the ratio is small, it is convenient for the user to use it. However, the rotating forces will be weak. The preferable ratio of a:b is about 2:3 to about 1:3.

Figure 5:
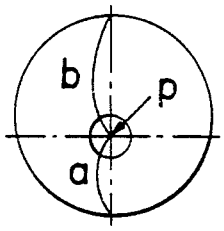
FIG. 5 is a rear view showing the ratio of eccentricity of the brushhead of the present invention.
Figure 6A:
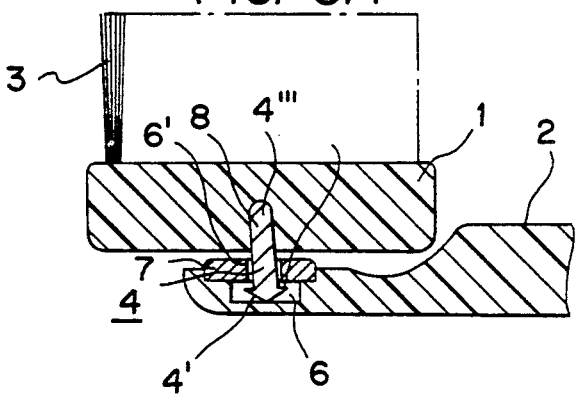
FIG. 6A is a sectional view showing an embodiment of rotative parts of the toothbrush of the present invention.
Figure 6B:
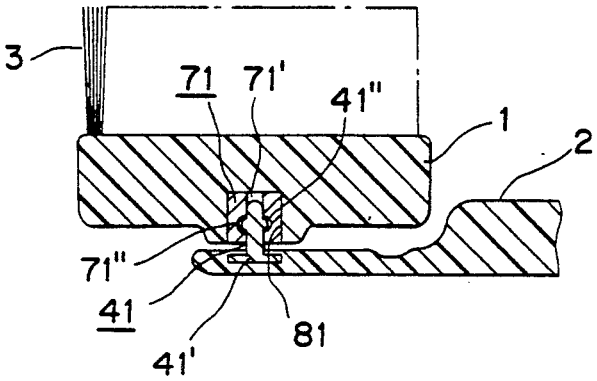
FIG. 6B is a sectional view showing another embodiment of the rotative parts of the rotative toothbrush of the present invention.
Figure 7:
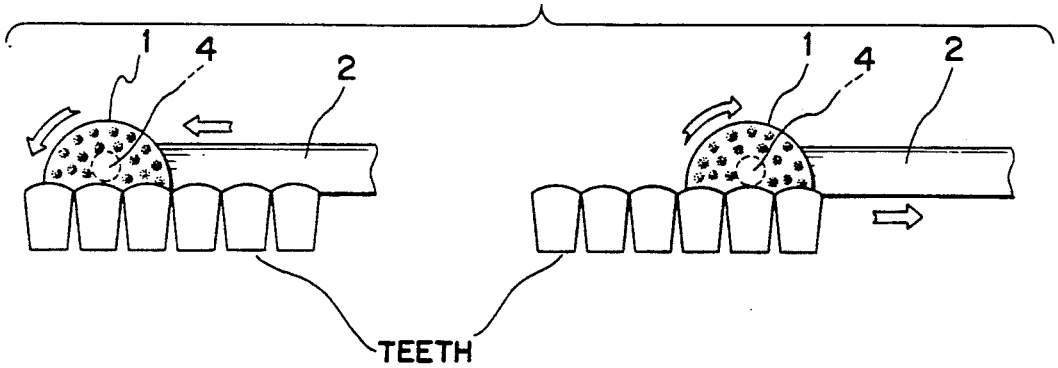
FIG. 7 is an explanatory view of using the toothbrush of the present invention.
Figure 8:
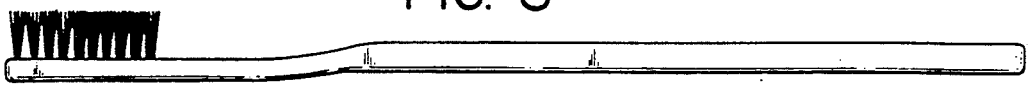
FIG. 8 is an external view of a conventional toothbrush.
Figure 9:
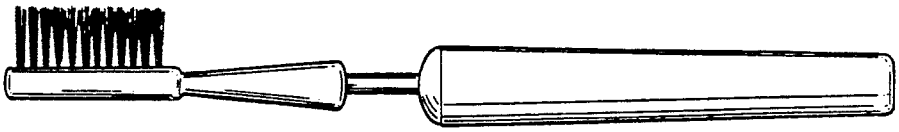
FIG. 9 is an external view of the toothbrush of U.S. Pat. No. 4,783,869.
Figure 10:
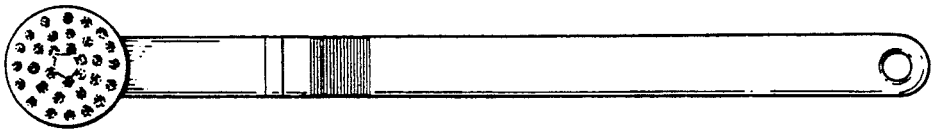
FIG. 10 is an external view of the toothbrush of Korean Utility Model Appln. No. 87-19458.
Figure 11:
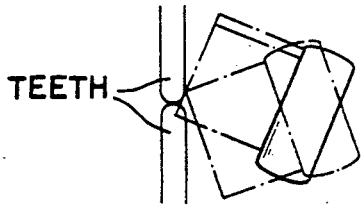
FIG. 11 is an explanatory view of suing the toothbrush of FIG. 9.

The brushhead 1, the grip 2, and brushhairs 3 can be made of the conventional plastic materials used in a conventional toothbrush. FIG. 6A shows an embodiment of the structure of the rotative parts of the toothbrush. The shaft 4 which has a rounded end 4' and a seal 4 is loosely set in a hole 6 formed in the end of the grip 2. The upper end 4''' of the shaft 4 is covered with a cap 7 having a hole 6' through the hole 6' and then the upper end 4''' is firmly fitted in a hole 8 of the brushhead 1. The cap 7 is sealed with the end of the grip 2 by a conventional way, e.g. by a supersonic sealing or by adhesives which are not solved in water or by heat-sealing method. FIG. 6B shows another embodiment of the rotative parts of the toothbrush. A base plate 41' of a shaft 41 is vertically molded into the upper end of the grip 2. Then, the shaft 41 is set into a housing 71 having a hole 71' and a groove 71'' in a way that the shaft 41 having a projection 41'' is loosely fitted into the hole 71' of the housing 71 having the groove 71''. Then, the housing 71 is fixed into a hole 81 of the brushhead 1. The shaft 4 or 41 becomes freely rotative in the set state.

There are other various conventional structures of the rotative parts which come under the scope of the present invention. As long as the thin shaft 4 is used, the thin shaft 4 becomes well rotative. However, it is desirable that the shaft 4 with a diameter from 0.5 mm to 2.0 mm is used. The shaft 4 can be made of metal or plastic. However, metal is more desirable than the plastic material because metal is usually more stronger than the plastic material.

When the user moves the grip of the toothbrush right and left in a conventional way, the brushhead 1 is rotated by 180 degrees at its maximum owing to the difference of the friction between the brushhairs of short radius and the brushhairs of long radius contacting the teeth. Therefore, the same effect of brushing the teeth vertically up and down is obtained when the toothbrush of the present invention is used in a conventional way.

FIG. 3 shows another embodiment of the rotative toothbrush of the present invention. In this case, one or more round projections 5 are formed on the back along the eccentric circle of the brushhead 1 (See FIGS. 4A and 4C. When the user uses the toothbrush having one or more round projections 5 on the back along the eccentric circle of the brushhead 1, the round projections 5 contact the inside muscle of the user's mouth and produce friction and contact a slot portion 2' of an end portion of the grip 2 and adjacent to the shaft 4 so as to effectively rotate the round brushhead 1 (FIGS. 6A and 6B); and therefore generate a kind of forces between the eccentric aperture P and the round projections 5. So, the brushhead 1 rotates more effectively and efficiently. Preferably, the round projection 5 numbers one, two, or three.

What we claim is:

1. A rotary toothbrush comprising:

a round brush head defining an inside and an outside;

a plurality of bristles arranged on said inside of the round brush head;

a grip member; and a shaft member extending from said grip member, said shaft member rotatively connected to an eccentric aperture disposed on said outside of the round brush head at the end of the shaft member, said eccentric aperture being disposed between a short radius and a long radius, whereby the round brush head rotates more effectively and efficiently so as to perfectly clean the teeth.

2. The rotary toothbrush according to claim 1, wherein a ratio of a length of said short radius and long radius is about 2:3 to about 1:3.

3. A rotary toothbrush comprising:

a round brush head defining an inside and an outside;

a plurality of bristles arranged on said inside of the round brush head;

a grip member;

a shaft member extending from said grip member, said shaft member rotatively connected to an eccentric aperture of said round brush head at the end of the shaft member, said eccentric aperture being disposed between a short radius and a long radius; and at least one round projection disposed on said outside along an eccentric circle which is disposed on a long radius portion of the round brush head for massaging inner muscle regions of the user's mouth, whereby the round brush head rotates more effectively and efficiently so as to perfectly clean the teeth.

4. The rotary toothbrush according to claim 3, wherein the projection numbers three.

5. The rotary toothbrush according to claim 3, wherein the projection numbers two.

6. The rotary toothbrush according to claim 3, wherein a ratio of length of the short radius and long radius is about 2:3 to about 1:3.

* * * * *